US009918503B2

(12) United States Patent
Macfarlane

(10) Patent No.: US 9,918,503 B2
(45) Date of Patent: Mar. 20, 2018

(54) GARMENT HAVING INTERCHANGEABLE PORTIONS

(71) Applicant: Mia Macfarlane, Toronto (CA)

(72) Inventor: Mia Macfarlane, Toronto (CA)

( * ) Notice: Subject to any disclaimer, the term of this patent is extended or adjusted under 35 U.S.C. 154(b) by 123 days.

(21) Appl. No.: 15/006,384

(22) Filed: Jan. 26, 2016

(65) Prior Publication Data

US 2017/0172230 A1 Jun. 22, 2017

Related U.S. Application Data

(60) Provisional application No. 62/268,770, filed on Dec. 17, 2015.

(51) Int. Cl.

| | |
|---|---|
| ***A41D 1/22*** | (2018.01) |
| ***A41D 15/00*** | (2006.01) |
| ***A41B 1/10*** | (2006.01) |
| ***A41D 1/04*** | (2006.01) |
| ***A41D 1/18*** | (2006.01) |
| ***A41D 3/00*** | (2006.01) |
| ***A41D 10/00*** | (2006.01) |
| ***A41D 27/08*** | (2006.01) |

(52) U.S. Cl.

CPC ..... *A41D 15/00* (2013.01); *A41B 1/10* (2013.01); *A41D 1/04* (2013.01); *A41D 1/18* (2013.01); *A41D 1/22* (2013.01); *A41D 3/00* (2013.01); *A41D 10/00* (2013.01); *A41D 27/08* (2013.01); *A41D 2300/32* (2013.01); *A41D 2300/322* (2013.01); *A41D 2300/324* (2013.01); *A41D 2300/326* (2013.01); *A41D 2400/44* (2013.01); *A41D 2400/70* (2013.01)

(58) Field of Classification Search

CPC ..... A41D 1/22; B63C 11/04; A41F 1/00

See application file for complete search history.

(56) References Cited

U.S. PATENT DOCUMENTS

| | | | | | |
|---|---|---|---|---|---|
| 1,250,836 | A * | 12/1917 | Fowler | A41D 1/22 | 2/109 |
| 2,493,531 | A * | 1/1950 | Fitches | A41D 15/00 | 2/115 |
| 3,116,491 | A * | 1/1964 | Previdi | A41D 1/20 | 2/102 |
| 3,877,078 | A * | 4/1975 | Tepper | A41D 1/06 | 2/106 |
| 5,029,344 | A * | 7/1991 | Shannon | A41D 15/005 | 2/115 |
| 5,083,316 | A * | 1/1992 | Kuehner | A41D 7/00 | 2/67 |
| 8,272,072 | B1 * | 9/2012 | Fowler | A41D 15/00 | 2/263 |

* cited by examiner

*Primary Examiner* — Tejash Patel

(74) *Attorney, Agent, or Firm* — Edgar Chana Law

(57) ABSTRACT

A garment worn on the upper body is disclosed having a right and left body portions that are joined at the front and rear by a corresponding fastening mechanism. This allows the right body portion and left body portion to separated from one another and interchanged with other body portions to vary the visual characteristics of the garment. The right and left body portions can have different visual characteristics.

9 Claims, 3 Drawing Sheets

GARMENT HAVING INTERCHANGEABLE PORTIONS

FIELD

The present disclosure relates generally to garments. More particularly, the disclosure relates to a fastening system on the garment to allow portions of the garment to be changed.

BACKGROUND

Presently, most clothing is made to be pulled over the head or includes a fastening arrangement on the front of the garment. For example, T-shirts and most sweaters are pulled over the head, and many jackets and outerwear have a front fastener arrangement, such as a zipper or buttons, along the front of the garment. These pull-over or front-fastening garments can be difficult for some to put on and take off.

The aesthetics or fashion appeal of these traditional garments is also limited because they only provide a singular fashion with a limited combination of colors or patterns. The visual characteristics of the garment is not changeable.

SUMMARY

According to a first aspect, a garment worn on the upper body is provided with a right body portion having a front and a rear; a left body portion having a front and a rear; a front fastening mechanism for joining the front of the right body portion with the front of the left body portion, a rear fastening mechanism for joining the rear of the right body portion with the rear of the left body portion, and wherein any one of the right body portion and the left body portion are interchangable with another corresponding body portion to change the visual characteristics of the garment.

In some aspects the front and rear fastening mechanisms can be medially arranged, and right body portion and left body portion are right and left halves of the garment. In other aspects of the garment, the front and rear fastening mechanisms can be non-medially arranged, such as diagonally arranged. The front and rear fastening mechanisms can be zippers, buttons, snaps, hook-and-eye, or hook-and-loop fasteners. Some aspects the garment can include a flap on the left body portion or the right body portion to cover any one or both of the front fastening mechanism and the rear fastening mechanism.

The garment is can be a T-shirt, a dress, a blouse, a sweater, a coat, a jacket, a polo shirt, a dress shirt, a pajama, a gown, a sweatshirt, and a vest. Preferably, the right body portion has a differing visual characteristic from that of the left body portion. The differing visual characteristics can be color, pattern, and texture/fabric.

BRIEF DESCRIPTION OF THE DRAWINGS

For a better understanding of the various embodiments described herein and to show more clearly how they may be carried into effect, reference will now be made, by way of example only, to the accompanying drawings which show at least one exemplary embodiment, and in which.

DESCRIPTION OF VARIOUS EMBODIMENTS

It will be appreciated that for simplicity and clarity of illustration, where considered appropriate, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementations of various embodiments described herein.

Figure 1B:
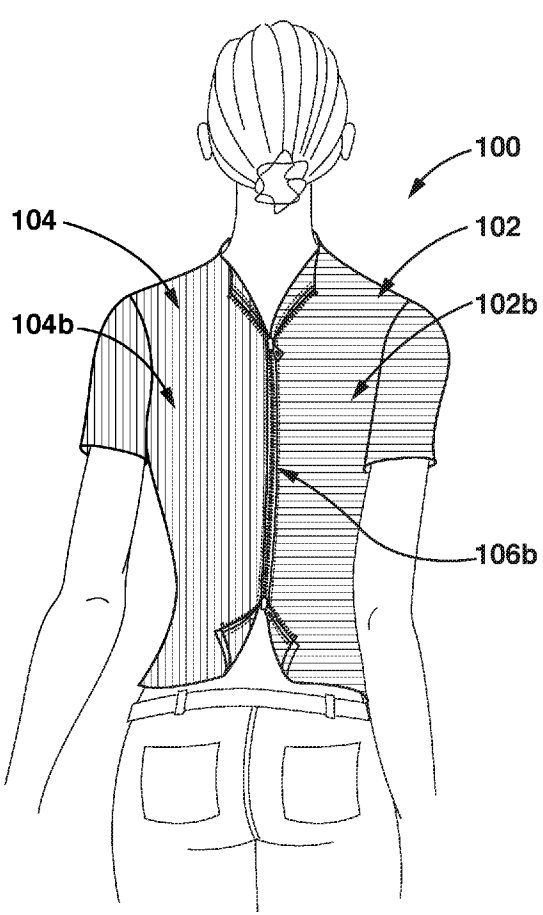
FIG. 1B is a rear view of the garment of FIG. 1A illustrating the rear fastening mechanism for joining the rear of the right and left body portions of the garment.
Figure 1A:
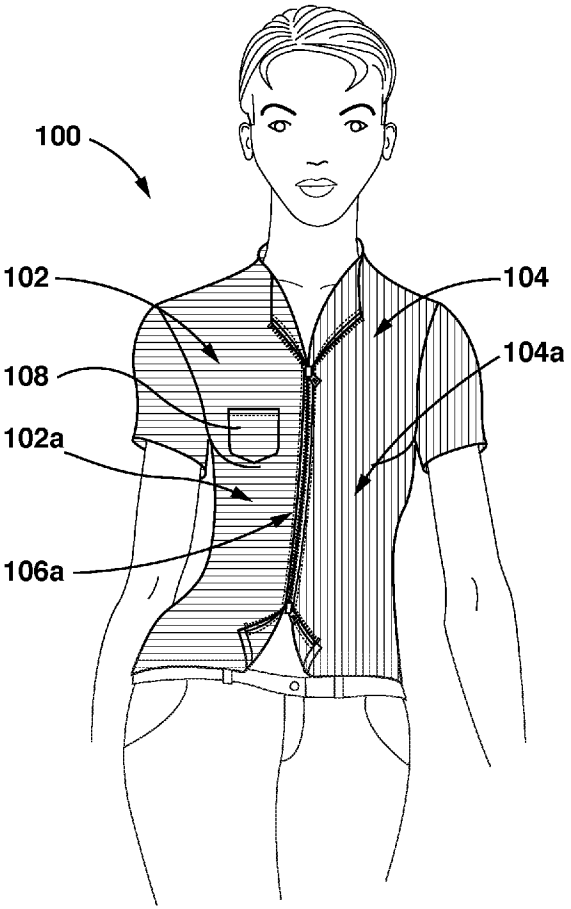
FIG. 1A is a front view of a garment illustrating the front fastening mechanism for joining the front of the right and left body portions of the garment.

Reference is first made to FIGS. 1A and 1B, shown is a garment 100 worn on the upper-body of a person with the garment having a right body portion 102 and a left body portion 104. Right body portion 102 covers the right half of the person's body and the left body portion 104 covers the left half of the person's body. Preferably, right body portion 102 and left body portion 104 are different colors. Right body portion 102 has a front 102*a* that covers a portion of the front of the person's body and a rear 102*b* that covers a portion of the rear of the person's body. Left body portion 104 has a similar front 104*a* and rear 104*b*.

A front fastening mechanism 106*a* is used to join the front 102*a* of right body portion 102 to the front 104*a* of left body portion 104 of garment 100. Similarly, a rear fastening mechanism 106*b* is used to join rear 102*b* of right body portion 102 to the rear 104*b* of left body portion 104. Fastening mechanisms 106*a* and 106*b* run from the top to the bottom of the front and rear of garment 100, respectively. This allows right body portion 102 to be completely separated from left body portion 104 by unfastening both fastening mechanisms 106*a* and 106*b*.

Using a fastening mechanisms 106*a* and 106*b* in this manner also allow the right and left body portions 102, 104 of the garment to be interchangeable with another corresponding body portion in order to change the visual characteristics of garment 100.

This allows for a great variety of possible visual characteristics that can be obtained with garment 100. Separate body portions of garment 100 can also allow the garment to be put on or taken off easier for individuals that have injuries or mobility issues, either by themselves or by a caregiver.

As shown in FIGS. 1A and 1B, right body portion 102 has a different color/pattern from left body portion 104. Using a number of right and left body portions 102, 104 with different colors, patterns, or materials allows for a number of different combinations to change the visual characteristics of garment 100. Preferably, right body portion 102 and left body portion 104 are different colors. Other embodiments can use different patterns, fabrics, or other design elements on each body portion of garment 100.

Some embodiments of garment can also include other design features to allow a person greater customization of the garment. For example, right body portion 102 can include a breast pocket 108, as shown in FIG. 1A, or have a plain front. Other design features could include graphics, lapels, epaulettes, peplum, or any other fashion elements.

Fastening mechanisms 106*a* and 106*b* can be a zipper as shown in FIGS. 1A and 1B. Other embodiments can use other fasteners, such as, for example, buttons, snaps, hook-and-eye, hook-and-loop (i.e. Velcro), or any other fasteners known in the art. Some embodiments can also include a flap on either right or left body portion to cover the fastening mechanisms 106*a* and 106*b*.

Figure 2B:
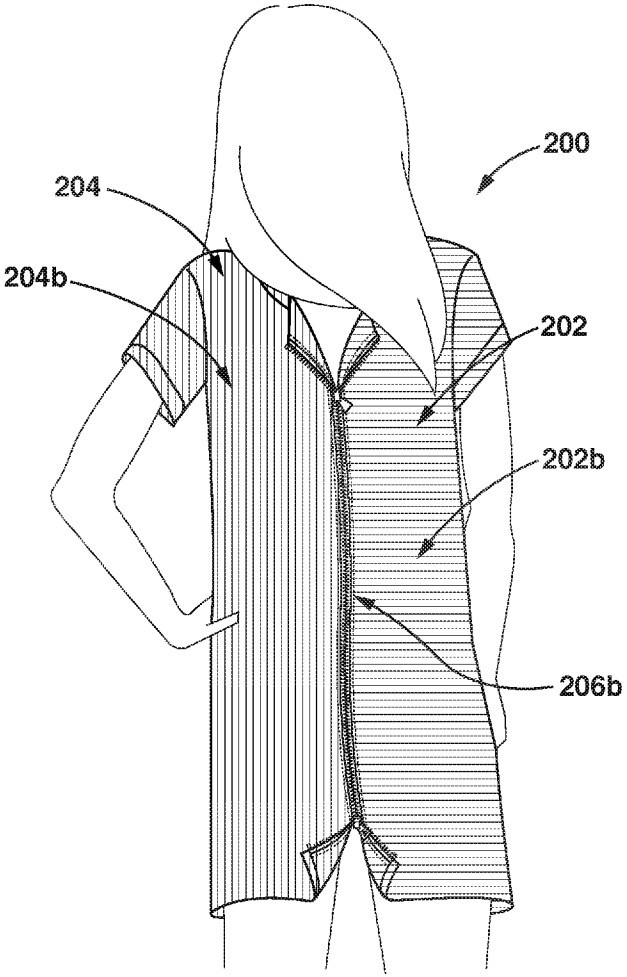
FIG. 2B is a rear view of the second garment of FIG. 2A illustrating the rear fastening mechanism for joining the rear of the right and left body portions of the garment.
Figure 2A:
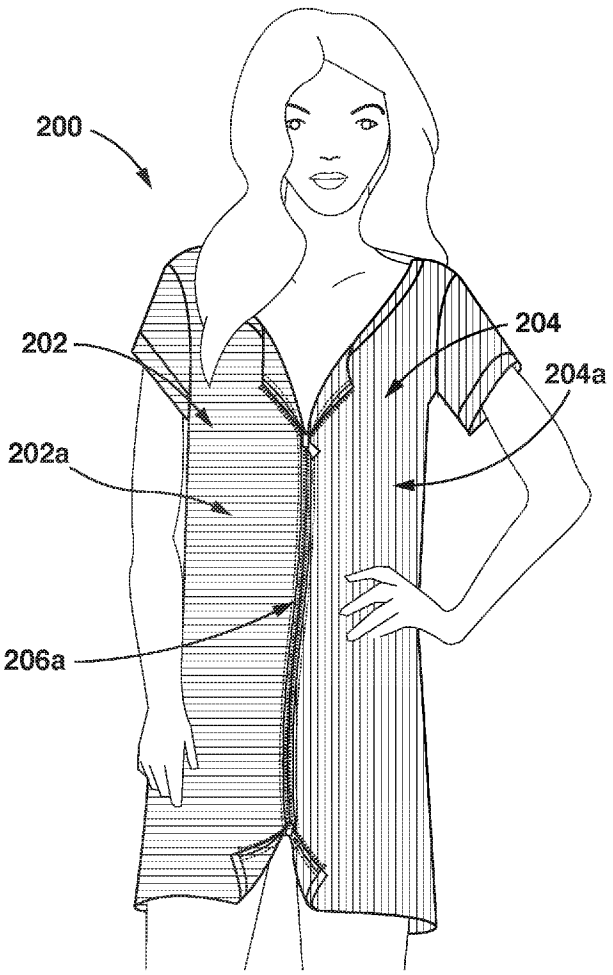
FIG. 2A is a front view of a second garment illustrating the front fastening mechanism for joining the front of the right and left body portions of the garment.
Figure 3B:
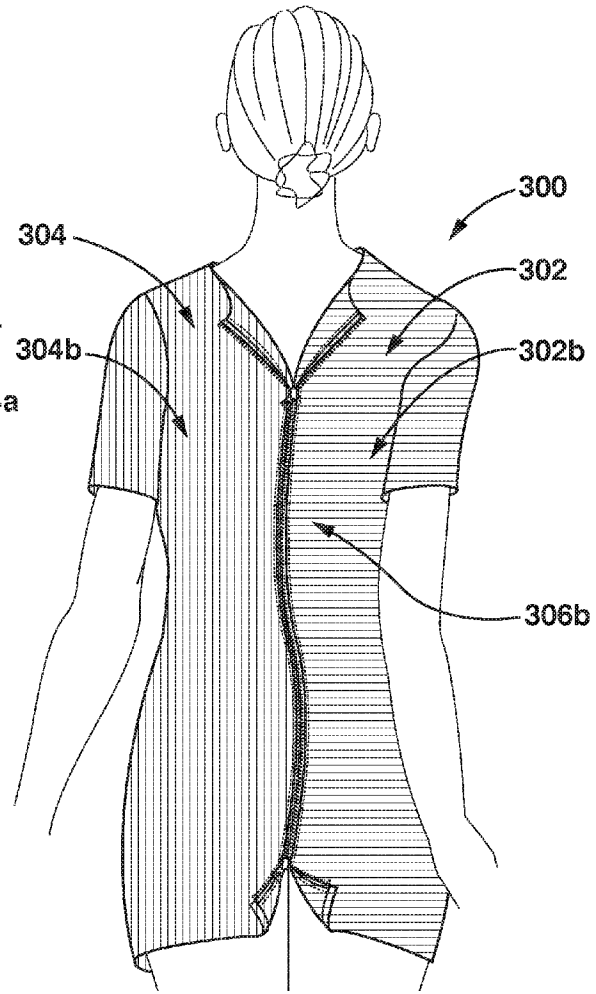
FIG. 3B is a rear view of the third garment of FIG. 3A illustrating the rear fastening mechanism for joining the rear of the right and left body portions of the garment.
Figure 3A:
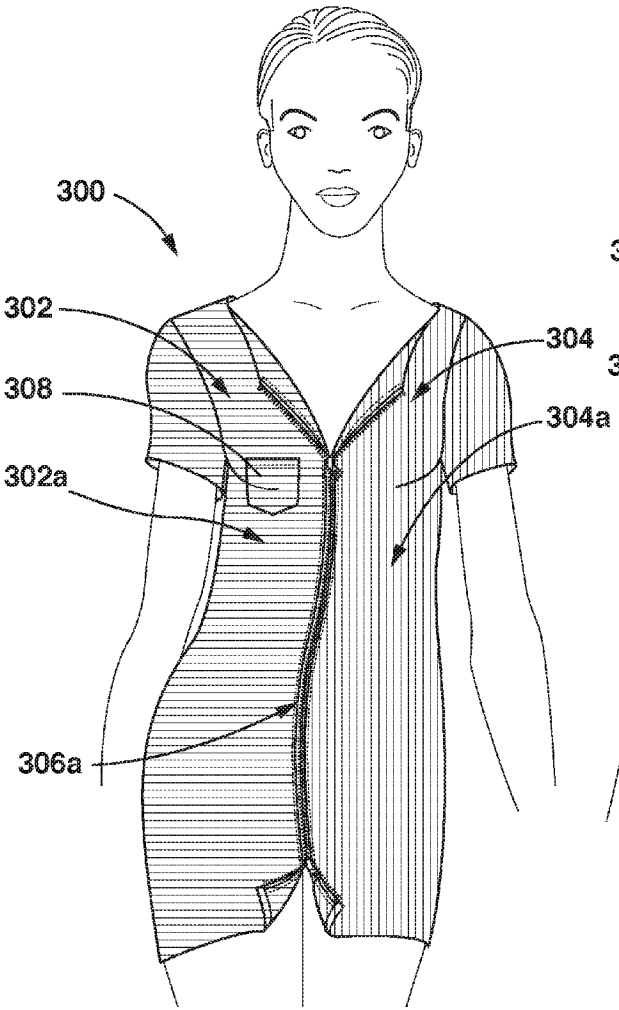
FIG. 3A is a front view of a third garment illustrating the front fastening mechanism for joining the front of the right and left body portions of the garment.

Embodiments can include any size, style or type of garment. Examples can include a T-shirt such as that shown in FIGS. 1A and 1B, a loose-fitting dress such as that shown in FIGS. 2A and 2B, or a tight-fitting dress such as that shown in FIGS. 3A and 3B. Similar reference numerals are used with respect to FIGS. 2A, 2B, 3A, and 3B as are used in FIGS. 1A and 1B to refer to similar elements.

Other garments can include, and are not limited to, blouses, sweaters, coats/jackets, polo shirts, dress shirts, pajamas, gowns, sweatshirts, and vests. Other variations to garments can include short or long sleeves; a long collar, short collar, or no collar; long dress or short dress; etc. Material used to construct garment can also vary such as cotton, cotton/synthetic mixes, wool, and other fabrics and materials as are known to those skilled in the art.

Although the illustrated embodiments show the garment with the fastening mechanisms medially arranged to divide the right and left body portions into halves, other embodiments can have the fastening mechanisms in a non-medial position. For example, the front and rear fastening mechanisms can be vertically arranged to meet between the collar and the left or right shoulder. Other embodiments of garment can have front and rear fastening mechanisms arranged diagonally across the front and rear of the garment.

While the exemplary embodiments have been described herein, it is to be understood that the invention is not limited to the disclosed embodiments. The invention is intended to cover various modifications and equivalent arrangements included within the spirit and scope of the appended claims, and scope of the claims is to be accorded an interpretation that encompasses all such modifications and equivalent structures and functions.

The invention claimed is:

1. A garment, comprising:

a right body portion having a front and a rear;

a left body portion having a front and a rear;

the garment further comprising fasteners, the fasteners consisting of:

a single front fastening mechanism for joining the front of the right body portion with the front of the left body portion, and a single rear fastening mechanism for joining the rear of the right body portion with the rear of the left body portion, wherein any one of the right body portion and the left body portion are interchangable with another corresponding body portion to change the visual characteristics of the garment by unfastening and refastening only the front and rear fastening mechanisms and changing any one of the right body portion and left body portion.

2. The garment of claim 1, wherein the front and rear fastening mechanisms are medially arranged, and right body portion and left body portion are halves of the garment.

3. The garment of claim 1 wherein the front and rear fastening mechanisms are non-medially arranged.

4. The garment of claim 3 wherein the front and rear fastening mechanisms are diagonally arranged.

5. The garment of claim 1 wherein the front and rear fastening mechanisms are any one of zippers, buttons, snaps, hook-and-eye, and hook-and-loop.

6. The garment of claim 1 further comprising a flap on any one of the left body portion and the right body portion to cover any one of the front fastening mechanism and the rear fastening mechanism.

7. The garment of claim 1 wherein the garment is any one of a T-shirt, a dress, a blouse, a sweater, a coat, a jacket, a polo shirt, a dress shirt, a pajama, a gown, a sweatshirt, and a vest.

8. The garment of claim 1 wherein the right body portion has a differing visual characteristic to the left body portion.

9. The garment of claim 8 wherein the differing visual characteristic can be any one or more of color, pattern, and texture.

* * * * *